United States Patent [19]

Umezu et al.

[11] 4,385,505

[45] May 31, 1983

[54] AIR CONDITIONER

[75] Inventors: Kenji Umezu, Shizuoka; Masakichi Watanabe; Minoru Nakada, both of Fuji; Toshiaki Hitosugi, Numazu, all of Japan

[73] Assignee: Tokyo Shibaura Denki Kabushiki Kaisha, Kawasaki, Japan

[21] Appl. No.: 254,126

[22] Filed: Apr. 14, 1981

[30] Foreign Application Priority Data

Apr. 15, 1980 [JP] Japan ..... 55-50003

[51] Int. Cl.[3] ..... F25D 21/14

[52] U.S. Cl. ..... 62/285; 165/122; 62/288; 62/298

[58] Field of Search ..... 62/285, 150, 288, 298; 165/122

[56] References Cited

U.S. PATENT DOCUMENTS 2,956,416 10/1960 Taylor ..... 62/285

FOREIGN PATENT DOCUMENTS 54-71843 6/1979 Japan ..... 62/285

*Primary Examiner*—Albert J. Makay
*Assistant Examiner*—Henry Bennett
*Attorney, Agent, or Firm*—Cushman, Darby & Cushman

[57] ABSTRACT

An air conditioner comprises a device body having first and second air channels, an evaporator disposed in the first air channel for cooling the air passing therethrough, a first drain tray disposed below the evaporator for receiving dew drops formed on the evaporator and falling therefrom and thus for containing the drain, and a second drain tray disposed below the first drain tray for receiving dew drops formed on the first drain tray and falling therefrom and the drain overflowing the first drain tray. The second air channel is defined between the first and second drain trays.

3 Claims, 12 Drawing Figures

AIR CONDITIONER

BACKGROUND AND SUMMARY OF THE PRESENT INVENTION

The present invention relates to an air conditioner and, more particularly, to an air conditioner having a drain tray for receiving dew drops deposited on the surface of an evaporator.

In an air conditioner, generally, air is cooled to a temperature lower than the dew point while heat is exchanged between the air and an evaporator, especially during cooling, so that dew drops are deposited on the surface of the evaporator. A drain tray is disposed below the evaporator for receiving the dew drops. The dew drops are deposited during the cooling process and have a low temperature. Thus, a drain tray for receiving the dew drops and a drain tube for exhausting the dew drops from the drain tray to the outside are cooled by the dew drops itself, and new dew drops are deposited outside the drain tray and the outer circumferential wall of the drain tube. These new dew drops can overflow onto the floor of the room in which the air conditioner is installed or the carpet on the floor, can cause rusting of the box body of the air conditioner or rot the wall near a hole through which the drain tube extends.

For these reasons, an air conditioner 10 has been conventionally constructed in the manner shown in FIG. 1. According to this construction, an evaporator 14 is arranged in the vicinity of a supply opening 12 of the air conditioner 10. The evaporator 14 functions to cool the air drawn through a suction opening 16 by the operation of a blower 18. A drain tray 20 for temporarily storing the dew drops dripping from the evaporator 14 is arranged below the evaporator 14. A drain tube 22 for draining the temporarily stored dew drops to the outside of the air conditioner 10 is connected to the drain tray 20. Heat insulating material 24 surrounds the drain tray 20 and the drain tube 22. Therefore, the drain tray 20 and the drain tube 22 are heat-insulated by the heat-insulating material 24 such that the coldness of their outer surfaces cooled by the dew drops is not conducted to the outer surface of the heat-insulating material. The deposition of additional dew drops on the outer surfaces of the drain tray 20 and the drain tube 22 due to the coldness of the dew drops already collected is thus prevented.

However, a large amount of the heat-insulating material 24 is required for achieving sufficient heat-insulating effects. It thus follows that this heat-insulating material 24 provides a great disadvantage for achieving a compact air conditioner 10. Further, since the heat-insulating material 24 is disposed around the drain tube 22, its outer diameter becomes large. Thus, the hole formed in the room wall for connecting the drain tray 20 to the outside from the room in which the air conditioner 10 is installed must be made larger so that the installation requires much labor. Further, an extra process is required for attaching the heat-insulating material 24 to the drain tray 20 and the drain tube 22, thus increasing the manufacturing cost.

It is, therefore, the primary object of the present invention to provide an air conditioner which is capable of preventing the deposition of the dew drops, on the drain tray and the drain tube so that energy conservation and greater compactness may be obtained.

According to one aspect of the present invention, there is provided an air conditioner comprising a device body having a first air channel and a second air channel which are provided parallel to each other and which communicate at one end with a supply opening of the device body and at the other end with a suction opening of the device body;

blowing means housed in said device body for introducing air from the outside into said device body through said suction opening, for separately passing the air through said first and second air channels, and for exhausting it outside said device body through said supply opening;

an evaporator disposed in said first air channel for cooling the air passing through said first air channel;

a first drain tray disposed below said evaporator for receiving dew drops formed on the evaporator and falling therefrom and thus for containing the resultant drain;

a second drain tray disposed below said first drain tray for receiving dew drops formed on said first drain tray and falling therefrom and the drain overflowing said first drain tray;

said second air channel being defined between said first and second drain trays, the dew drops which fall from said first drain tray and the drain which overflows said first drain tray to said second drain tray being heated by the air passing through said second air channel.

BRIEF DESCRIPTION OF THE ACCOMPANYING DRAWINGS

This invention can be more fully understood from the following detailed description when taken in conjunction with the accompanying drawings, in which.

DETAILED DESCRIPTION OF THE PREFERRED EXEMPLARY EMBODIMENTS

Figure 1:
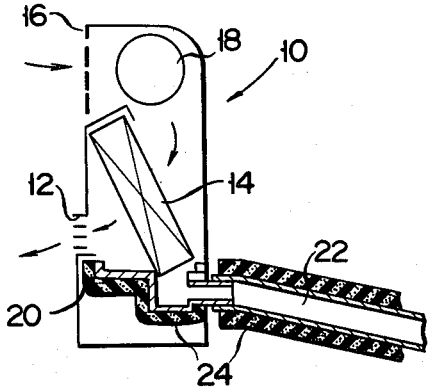
FIG. 1 PRIOR ART
FIG. 1 is a schematic view of a conventional air conditioner.
Figure 2:
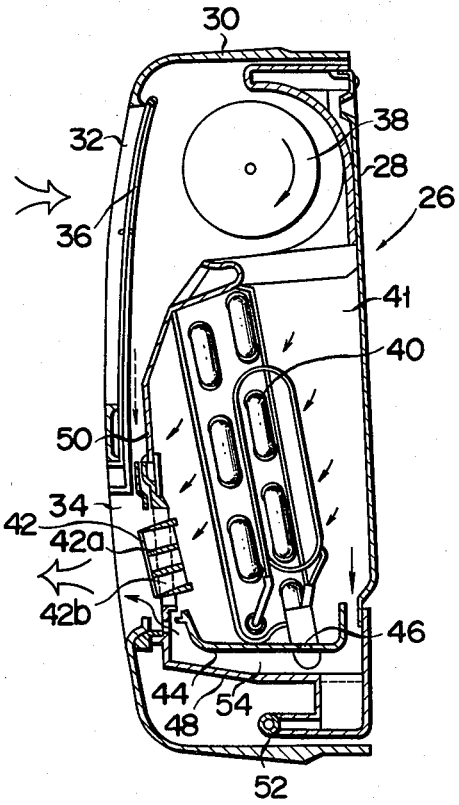
FIG. 2 is a side sectional view of a first embodiment of the air conditioner according to the present invention.
Figure 3:
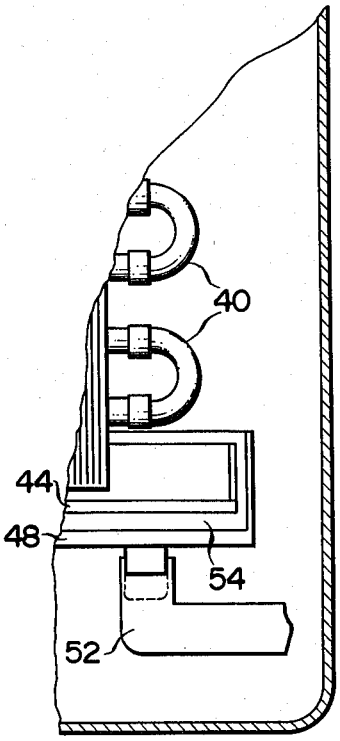
FIG. 3 is a front view of the main part of the device shown in FIG. 2.

A first embodiment of the air conditioner according to the present invention will now be described in detail with reference to FIGS. 2 and 3 of the accompanying drawings.

An air conditioner 26 according to this embodiment comprises a device body 28, and a front panel 30 detachably mounted on the device body 28 and covering the entire front surface of the device body 28. An opening defined as a suction opening 32 is formed at the upper front of the front panel 30, and another opening defined as a supply opening 34 is formed at the lower front of the panel. A filter 36 is incorporated in the device body 28 opposing the suction opening 32. This filter 36 is detachable from the device body 28. A blower 38 is mounted inside of the device body 28 opposing the suction opening 32, i.e., at the top of the device body 28. This blower 38 is so constructed that the air inside the room in which is installed the air conditioner 26 is sucked inside the device body 28 through the suction opening 32 and then blown out of the device body 28 through the supply opening 34.

An evaporator 40 as one component of the freezing cycle is arranged inside the device body 28 opposing the supply opening 34, that is, the lower part of the inside of the device body 28. The other components of the freezing cycle will not be shown or described. This evaporator 40 is so constructed as to perform heat exchange with the air passing therethrough. Especially in this embodiment, the evaporator 40 extracts heat from the air passing therethrough for cooling it. The evaporator 40 may alternatively be so constructed that, by a switching operation, heat is provided to the air passing therethrough for heating it. The evaporator 40 is disposed in a part defined as a first air channel 41 through which most of the air flowing from the suction opening 32 to the supply opening 34 by the blower 38 passes.

A flow-direction adjusting grill 42 is arranged inside of the device body 28 so as to be disposed inside the supply opening 34. The flow-direction adjusting grill 42 is so constructed that the flow of the air supplied from the device body 28 through the supply opening 34 and cooled by the evaporator 40 is directed thereby. The flow-direction adjusting grill 42 has a plurality of fins **42*a* and 42*b* respectively extending horizontally and vertically. The horizontally arranged fins 42*a* are pivotable to regulate the direction of the vertical supply of air. The vertically arranged fins 42*b*** are pivotable, thus determining the direction of the horizontal supply of air.

Figure 4:
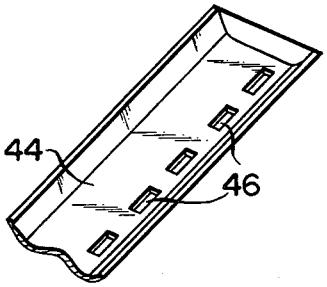
FIG. 4 is a perspective view of a first drain tray used in the device shown in FIG. 2 separated from the other parts.

A first drain tray 44 is housed inside the device body 28 below the evaporator 40. The first drain tray 44 is so constructed as to receive dew drops deposited by the evaporator 40 and dripping therefrom. A through hole 46 is formed in a bottom plate of the first drain tray 44 along the direction of the thickness for suitably conveying the temporarily drain, i.e. stored dew drops as shown in FIG. 4 to below the drain tray. The through hole 46 is large enough to convey the drain faster than the dew drops accumulate in the first drain tray 44 so that the drain does not overflow the tray 44. But it must be small enough to transfer the heat of air passing through a second air channel 54 (described later) effectively to the cold drain flowing through it.

A second tray 48 is disposed apart from the first drain tray 44 by a predetermined space and inside the device body 28. The second drain tray 48 receives the drain temporarily stored in the first drain tray 44 and flowing through the through hole 46, and also additional dew drops deposited at the lower surface of the first drain tray 44. A drain guide member (not shown) is mounted to the supply opening 34 so that the dew drops deposited on a frame 50 of the device body 28 located in front of the evaporator 40 is received by the second drain tray 48. A drain tube 52 for exhausting the drain, i.e. dew drops stored in the second drain tray 48 is connected thereto.

Space between the first and second drain trays 44 and 48 is defined as the second air channel 54. The second air channel 54 communicates with the suction opening 32 at one end and with the supply opening 34 at the other end. Through the second air channel 54 there passes a part of the air drawn by the blower through the suction opening 32. The heat of the air is transferred to the dew drops falling from the first drain tray 44 and the frame 50 and the drain overflows the tray 44, whereby the air is cooled. The air cooled is supplied into the room through the supply opening. The section of the channel 54 cut in a plane perpendicular to the direction in which air flows through the channel 54 is of such size that the air can perform an effective heat exchange with the drain and the dew drops, thereby heating the drain and the dew drops to a temperature over the dew point.

It will now be described how the first embodiment of the invention is operated.

First, the evaporator 40 is cooled. The blower 38 is started. Air is thus drawn into the device body 28 through the suction opening 32. Most of the air passes through the first air channel 41 and through the evaporator 40. While passing through the evaporator 40, the air is cooled. The air thus cooled is made to flow in a specific direction, regulated by the flow direction adjusting grill 42. It is farther supplied through the supply opening 34.

When the evaporator 40 cools the air passing therethrough to a temperature lower than the dew point of water, drops of water are formed on the surface of the evaporator 40. The dew drops fall from the evaporator 40 due to its own weight, and is received by the first drain tray 44. On the one hand, since the dew drops are sufficiently cooled, the first drain tray 44 is cooled by the dew drops received therein. The lower surface of the first drain tray 44 defines the upper surface of the second air channel 54, so that it is exposed to the part of the air which is not cooled by the evaporator 40, that is, to the warm air from inside the room. Accordingly, the additional dew drops are deposited on the lower surface of the first drain tray 44. On the other hand, the air cooled by passing through the evaporator 40 strikes the frame 50 in front of the device body 28 and cools it. Since the front surface of the frame 50 faces the room in which the air conditioner is installed, it is exposed to the warm air inside the room. Due to this, dew drops are also deposited on the front surface of the frame 50.

The dew drops thus produced by the evaporator 40 and received by the first drain tray 44 flow to the second drain tray 52 through the through hole 46 and is received therein. The dew drops deposited at the lower surface of the first drain tray 44 drips onto and is received by the second drain tray 48. The dew drops deposited at the front surface of the frame 50 also drip as shown by the broken lines in the figure and is received by the second drain tray 48 as guided by a guide (not shown).

Consequently, the dew drops deposited at all three parts must pass through the second air channel 54 before it is received by the second tray 48. That part of the air of the room passes through the second air channel 54, which does not pass through the evaporator 40. This part of the air is at a temperature near room temperature and is thus high compared with the temperature of the dew point. Thus, the dew drops deposited at all three parts receive heat from the warm air so that the dew drops are heated and the passing air is cooled.

In this manner, the warmed dew drops reach the second drain tray 48, which never reaches a temperature below the dew point. Further, the drain tube 52 for exhausting the drain from the second drain tray 48 to the outside is not cooled by the drain to a temperature below the dew point.

No dew drops are therefore formed on the second drain tray 48 or the drain tube 52. Thus, neither the second drain tray 48 nor the drain tube 52 needs to be covered with a heat-insulating material. In other words, dew drops are not formed on the tray 48 and the tube 52 if they are not covered with a heat-insulating material whatever.

As a result, the effects to be described below may be obtained in the first embodiment.

(1) Since the heat-insulating material for the first and second drain trays 44 and 48 is not necessary, the air conditioner 26 may be made more compact and the manufacture may be made simpler due to the simple construction.

(2) Since the heat-insulating material for the drain tube 52 is not necessary, the air conditioner may be made thinner. Further, the hole to be formed in the room wall for connecting the drain tube 52 to the outside during installation may be made smaller so that the efficiency of the installation and the appearance after the installation may be improved.

(3) Energy conservation is facilitated since the lower temperature of the exhaust drain is utilized to cool the air passing through the second air channel 48.

(4) Since the first and second drain trays 44 and 48 and the drain tube 52 may be constructed without using the heat-insulating material, the manufacture becomes easy and the manufacturing cost is lowered.

Figure 5:
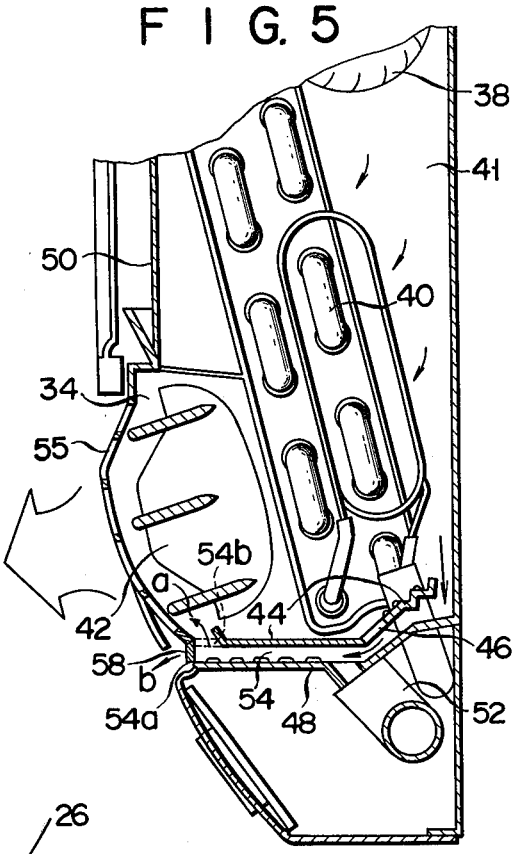
FIG. 5 is a side sectional view of a second embodiment of the present invention.

In the first embodiment described above, the air passing through the second air channel 54 is not regulated in its direction by the flow-direction adjusting grill 42, and it blows unidirectionally. With the construction of a second embodiment described with reference to FIG. 5 below, the blowing direction of the air passing through the second air channel 54 may be regulated. The same parts as in the first embodiment are designated by the same reference numerals, and their description will be omitted.

A grill protector 55 having a number of openings is disposed at the supply opening 34. Flow direction varying elements 58 are disposed at the lower end of the grill protector 55 in a manner to enable manual adjustment. These flow-direction varying elements 58 are formed of an elastic synthetic resin such as polypropylene. At the front end of the second air channel 54 are formed first openings 54*a* directly opening to the outside and second openings 54*b* communicating with the first air channel 41. The flow-direction varying elements 58 close either the first openings 54*a* or the second openings 54*b*. When the first openings 54*a* are closed by the flow varying elements 58, the air passing through the second air channel 54 is guided through the second openings 54*b* to the first air channel 41 as shown by arrow a and meets the air passed through the first air channel 41. Thereafter, it is regulated in its blowing direction by the flow-direction adjusting grill 42 to be blown to the outside. When the second openings 54*b* are closed by the flow direction varying elements 58, the air which has passed the second air channel 54 is directly blown to the outside through the first openings 54*a*, as shown by arrow b. In this case, the air blowing through the first openings 54*a* is not regulated in its direction and is set in one direction only.

By closing either the first openings 54*a* or the second openings 54*b* through the flow-direction varying elements 58, the flow direction to the outside of the air which has passed through second air channel 54 may be arbitrarily set.

Figure 6:
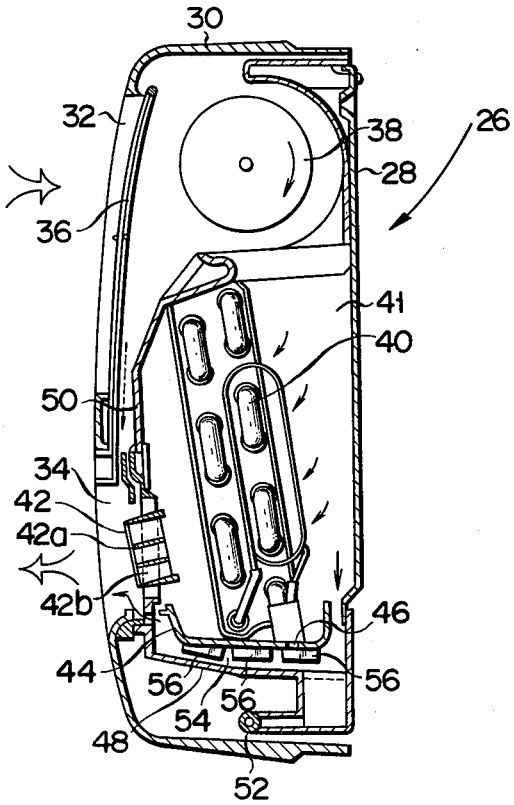
FIG. 6 is a side sectional veiw of a third embodiment of the present invention.
Figure 7:
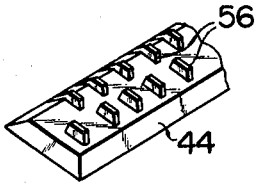
FIG. 7 is a perspective view of fins used in the device shown in FIG. 6 together with the first drain tray separated from the other parts.

A third embodiment of the air conditioner according to the present invention will be described with reference to FIGS. 6 and 7.

As shown in these figures, a plurality of fins 56 extending to the middle of the second air channel 54 are arranged at the lower surface of the first drain tray 44. The distance between two adjacent fins 56 is set to increase in a geometrical progression. The distance between these fins may alternatively be set at random. By incorporating these fins 56, the dew drops deposited on the lower surface of the first drain tray 44 flow along the fins 56 and drips to the second drain tray 48. Since these fins 56 are heated by the warm air passing through the second air channel 54, the dew drops flowing along the fins 56 are heated by the warm air as well as by the fins 56. Therefore, the dew drops flowing from the first drain tray 44 to the second tray 48 are heated more than in the case of the first embodiment on the fins 56. Thus, since the dew drops received by the second drain tray 48 are heated to a temperature sufficiently above the dew point, the additional dew drops are not deposited on the outer surfaces of the second drain tray 48 and the drain tube 52 even though they are not covered with a heat-insulating material.

Figure 8:
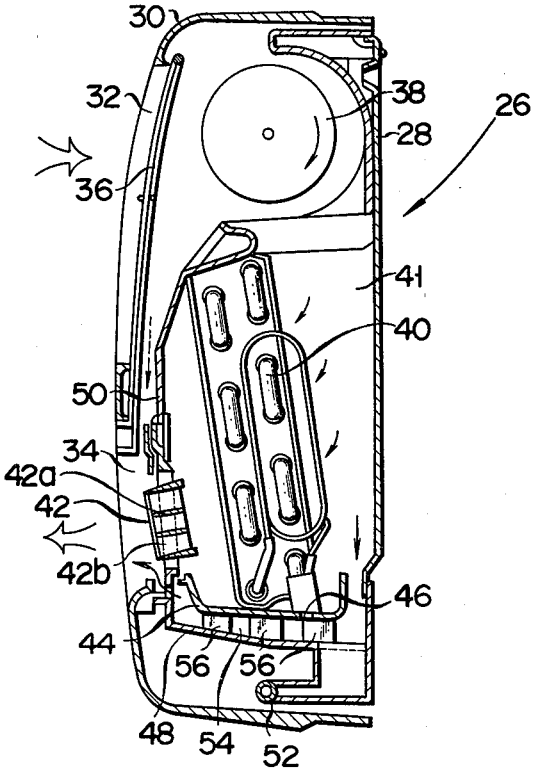
FIG. 8 is a side sectional view of a fourth embodiment of the present invention.
Figure 9:
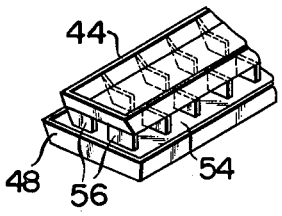
FIG. 9 is a perspective view of fins used in the device shown in FIG. 8 together with the first and second drain trays separated from the other parts.

In the third embodiment, the fins 56 were described as extending to the middle of the second air channel 54. However, the present invention is not limited to this particular construction. For example, the construction may be as in a fourth embodiment shown in FIGS. 8 and 9. In this fourth embodiment, the fins 56 are arranged so as to connect the first drain tray 44 and the second drain tray 48. With such a construction, the same effects as obtained according to the third embodiment may be obtained. In addition, the mutual strength of the first drain tray 44 and the second drain tray 48 may be improved.

Figure 10:
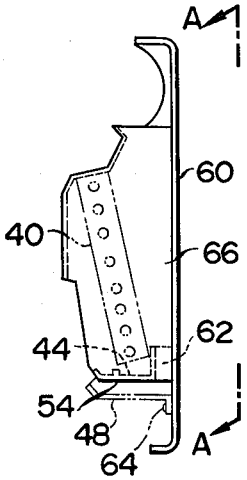
FIG. 10 is a partial side view of a fifth embodiment of the present invention.
Figure 11:
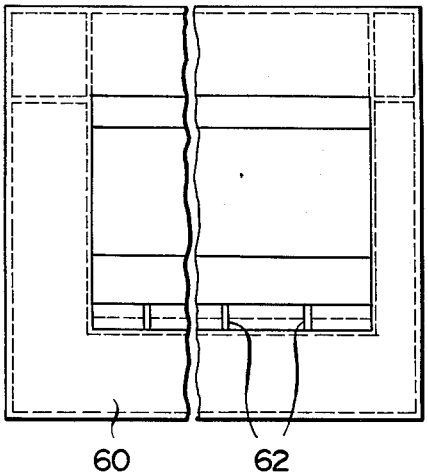
FIG. 11 is a rear view of the device shown in FIG. 10 along the line A—A.
Figure 12:
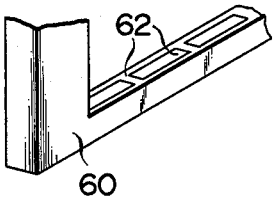
FIG. 12 is a perspective view of reinforcing ribs used in the device shown in FIG. 10 separated from the other parts.

In the above embodiment, the first drain tray 44 and the second drain tray 48 were arranged separately of each other. However, the present invention is not limited to this particular construction. For example, at least one of them may be formed integrally with a rear plate 60 of the device body 28 as in a fifth embodiment, shown in FIGS. 10 to 12. For example, by mounting the rear side of the first drain tray 44 to the inner side of the rear plate 60 of the device body 28 by means of a plurality of reinforcing ribs 62, the first drain tray 44 is formed integrally with the rear plate 60. The strength of the first drain tray 44 supporting the evaporator 40 may be improved by this integral formation. The second drain tray 48 is secured to the rear plate 60 by fastening with a screw 64, and is partially connected to the lower part of the first drain tray 44 by a screw or fitting means. The spaces between the respective reinforcing ribs 62 form the inlet of the second air channel 54.

A side plate 66 is secured to the rear plate 60. This side plate 66 functions as a partitioning plate between the space for mounting a motor (not shown) and the cooling space, as well as a dew introducing plate. Thus, the side plate 66 is capable of introducing the dew deposited on the inner side thereof to the first drain tray 44.

As has been described, the present invention is not limited to the construction in which the first drain tray 44 and the rear plate 60 are integrally formed. Thus, it is to be understood that the second drain tray 48 and the rear plate 60 may be formed integrally with each other. With such a construction, the strength may be improved at the securing part of the second drain tray 48 and the rear plate 60.

Thus, according to the fifth embodiment, the strength may be improved in addition to the other effects obtained according to the first embodiment.

What we claim is:

1. An air conditioner comprising:

a device body having a supply means, a suction means including a suction opening, and first and second air channels which are provided parallel to each other and which communicate at one end with said supply means and at the other end with said suction means;

blowing means including a blower set near said suction opening and housed in said device body for introducing air from the outside into said device body through said suction means, for separately passing air through said first and second air channels, and for exhausting it outside said device body through said supply means;

an evaporator disposed in said first air channel for cooling the air passing through said first air channel;

a first drain tray disposed below said evaporator for receiving dew drops formed on the evaporator and falling therefrom and thus for containing the resultant drain; and a second drain tray disposed below said first drain tray for receiving dew drops formed on said first drain tray and falling therefrom and the drain overflowing said first drain tray;

said second air channel being defined between said first and second drain trays, the dew drops which fall from said first drain tray and the drain which overflows said first drain tray to said second drain tray being heated by the air passing through said second air channel, wherein said supply means further includes;

(a) first and second supply openings, said first supply opening being in communication with said first air channel and said second supply opening being in communication with said second air channel, (b) a flow-direction adjusting grill provided in said first air channel near said first supply opening, (c) connecting means for selectively connecting that portion of said second air channel which lies downstream of said first and second drain trays to that portion of said first air channel that lies downstream of said evaporator, and (d) a member which selectively closes said connecting means and said second supply opening, whereby when said connecting means is closed by said member said second air channel communicates with said second supply opening, and when said second supply opening is closed by said member said second air channel communicates with said first supply opening, said air passing through said second air channel being regulated in its direction by said flow-direction adjusting grill.

2. The air conditioner according to claim 1 wherein said first drain tray has a through opening for allowing the dew drops stored therein to flow to said second drain tray.

3. The air conditioner according to claim 2, wherein at least one of said first and second drain trays has fins extending into said air channel.

* * * * *